US007842170B1

(12) United States Patent
von Detten

(10) Patent No.: US 7,842,170 B1
(45) Date of Patent: Nov. 30, 2010

(54) DEVICE FOR SELECTIVE PLATING OF ELECTRICAL CONTACTS FOR CONNECTORS

(76) Inventor: Volker von Detten, 535 E. Walnut Ave., #A, El Segundo, CA (US) 90245

( * ) Notice: Subject to any disclaimer, the term of this patent is extended or adjusted under 35 U.S.C. 154(b) by 0 days.

(21) Appl. No.: 12/590,080

(22) Filed: Nov. 2, 2009

Related U.S. Application Data

(60) Provisional application No. 61/209,616, filed on Mar. 9, 2009.

(51) Int. Cl.

| | |
|---|---|
| ***C25D 5/02*** | (2006.01) |
| ***C25D 5/08*** | (2006.01) |
| ***C25D 7/00*** | (2006.01) |
| ***C25D 17/04*** | (2006.01) |
| ***C25D 17/06*** | (2006.01) |

(52) U.S. Cl. ..... 204/237; 204/275.1; 205/118; 205/122; 205/128; 205/131; 205/134

(58) Field of Classification Search ..... 205/134
See application file for complete search history.

(56) References Cited

U.S. PATENT DOCUMENTS

| | | | | |
|---|---|---|---|---|
| 4,153,523 | A * | 5/1979 | Koontz et al. | 205/668 |
| 4,278,520 | A * | 7/1981 | Turner | 204/207 |
| 4,280,882 | A * | 7/1981 | Hovey | 205/50 |
| 4,427,498 | A * | 1/1984 | Wagner | 205/122 |
| 4,473,445 | A * | 9/1984 | Smith et al. | 439/886 |
| 4,904,364 | A * | 2/1990 | Davis et al. | 204/224 R |
| 5,180,482 | A * | 1/1993 | Abys et al. | 205/224 |
| 5,372,700 | A * | 12/1994 | Pilorge et al. | 205/131 |
| 7,070,688 | B2 * | 7/2006 | Donovan, III | 205/128 |
| 2008/0006526 | A1 * | 1/2008 | von Detten | 204/198 |

* cited by examiner

*Primary Examiner*—Harry D Wilkins, III
(74) *Attorney, Agent, or Firm*—Gene Scott; Patent Law & Venture Group

(57) ABSTRACT

This invention relates generally to a method and apparatus for electroplating selected portions of a high contact force, high elastic response range pin-receiving and cylindrical electrical contact having a pair of spaced apart cantilever beams which extend forwardly from a base to a pin-receiving end. In accordance with the invention at least one plating cell is provided including a cavity type of enclosure thereof in general matching the outer contour of the lower portion and pin receiving end of the contact whereas plating solution is ejected towards the pin receiving end including at least one conducting device for electric current is provided adjacent to the opposite region of the contact for engaging with thereof whereas electric current is being conducted.

10 Claims, 6 Drawing Sheets

DEVICE FOR SELECTIVE PLATING OF ELECTRICAL CONTACTS FOR CONNECTORS

RELATED APPLICATIONS

This application claims the priority date of a prior filed application having Ser. No. 61/209,616 and filing date of Mar. 9, 2009 and entitled: Device to selective plate female and male electrical contacts.

INCORPORATION BY REFERENCE

Applicant(s) herein incorporate by reference, any and all U.S. patents and U.S. patent applications cited or referred to in this application.

BACKGROUND OF THE INVENTION

1. Field of Invention

This invention relates to electroplating and more particular to the localized plating of different areas of a singular part with various metals.

2. Description of Related Art

The following art describes the present state of this field:

Electroplating is a coating process for metals to be applied onto a basis metal surface. The coating or plating process is accomplished by means of an electrolyte solution which enables the to be plated metal to be deposited from either metal chip anodes—same metal as to be plated—or neutral metal anodes for plating from the electrolyte through application of a current. The current is supplied by means of a rectifier or power supply. The current is variable whereby the voltage is low and constant. The positive terminal of the rectifier is connected to the anode and the negative terminal to the to be plated part or cathode. Both the anode and parts or cathode typically are fully submerged in the electrolyte. The electrolyte is water based with dissolved salts thus making the electrolyte conductive sustaining a relative low electrical resistance. Once current is applied to the now closed circuit the metal is being deposited onto the part's surface. In case of precious metal plating and specifically gold the gold is suspended in form of gold salts in the electrolyte. The current will enable the gold to be carried out of suspension and deposited onto the part. Whichever portion of the part is selected to be submerged in the electrolyte that is the portion, which will be plated with gold. These electrical contacts come in many configurations and sizes. When the contacts are being plated they are connected with a contactor for the application of current for the plating process. As there is a plurality of contacts being plated in one cycle it is essential that all contacts have a proper connection to the power supply via a contactor as such at least one contactor is assigned to one contact. Location and presentation of the contacts is accomplished with a pallet having an array of through holes arranged in an equally spaced array in such a way that the holes are in alignment vertically with locator sleeves in coaxial fashion provided by a locator plate below the pallet. When the holes of the pallet are properly aligned to be coaxial with the locator sleeves below a contact or other long cylindrical object can be inserted with its far end coming to rest on a locator ledge of the sleeve. Once all holes are filled with the components the plating process can commence. Thus the components can now be exposed to the electrolyte liquid for coating same components in a localized and predetermined area of the component. This type of plating process is commonly known as selective plating meaning that gold or other applicable precious metal is being deposited exclusively in strategic areas of the contact. Strategic areas are where the mating of female to male contact takes place for proper electric conductance once assembled in a connecting device. Specifically applicable to female contacts better known as socket contacts the selective plating as present art teaches does not minimize gold consumption. The reason for this is that the mating end of the contact is exposed to the electrolyte whole meaning that not exclusively the inside diameter or mating area is being plated with thick gold but the outer diameter is being plated with an even thicker layer of gold simultaneously. The reason for this is that the outer diameter of the contact is exposed to the electrolyte at a higher degree in terms of volumetric exchange thereof than the inside diameter of the contact thereby resulting in a higher plating efficiency for the outside diameter. Although prior art selective plating remains to be an economically viable process application it does not reduce gold consumption nearly to the degree as is desirable.

No prior art device is known to achieve discrete plating of female contacts as a method and apparatus for electroplating selected portions of the female contacts and specifically describing a method wherein aforesaid are plated simultaneously, consistently and accurately wherein all selected portions of the contacts not to be plated or at least to be plated with a minimum thickness remain so consistently not plated or at least plated by resulting in a minimum thickness respectively.

SUMMARY OF INVENTION

The present invention teaches certain benefits in construction and use, which give rise to the objectives described below.

This invention relates generally to a method and apparatus for electroplating selected portions of a high contact force, elastic response range pin-receiving and cylindrical electrical contact having a pair of spaced apart cantilever beams which extend forwardly from a base to a pin-receiving end. In accordance with the invention at least one plating cell is provided including a cavity type of enclosure thereof in general matching the outer contour of the lower portion and pin receiving end of the contact whereas plating solution is ejected towards the pin receiving end including at least one conducting device for electric current is provided adjacent to the opposite region of the contact for engaging with thereof whereas electric current is being conducted.

A primary objective of one embodiment of the present invention is to provide an apparatus and method of use of such apparatus that yields advantages not taught by the prior art.

A still further objective is to assure that an embodiment of the invention is capable of plating individual contacts thereby applying the plating to discreet areas of the contacts.

A still further objective is to assure that an embodiment of the invention is capable of plating the individual contacts simultaneously, complete and at high speed.

A still further objective is to assure that an embodiment of the invention is to assure that individual contacts are plated at a uniform thickness of plating.

A still further objective is to assure that an embodiment of the invention is that the individual contact can be plated at a higher thickness of the metal in areas where it is needed and not to include areas where it is not needed.

A still further objective is to assure that an embodiment of the invention is that preparation of the contacts for the plating process does not require skilled labor and is relatively easy to use.

A still further objective is to assure that an embodiment of the invention is that contacts of various dimensions and configurations respectively can be plated without the need for labor-intensive changes between production batches of contacts. Aforesaid shall result in maximization of efficiency, reduction in labor and reduction in capital expenditures for the plating equipment.

Other features and advantages of the embodiments of the present invention will become apparent from the following more detailed description, taken in conjunction with the accompanying drawings, which illustrate, by the way of example, the principles of at least one of the possible embodiments of the invention.

BRIEF DESCRIPTION OF THE DRAWINGS

The accompanying drawings illustrate at least one of the best mode embodiments of the present invention. In such drawings.

The above-described drawing figures illustrate the present invention in at least one of its preferred, best mode embodiments, which are further, defined in detail in the following description. Those having ordinary skill in the art may be able to make alterations and modifications in the present invention without departing from its spirit and scope. Therefore it must be understood that the illustrated embodiments have been set forth only for the purposes of example and that they should not be taken as limiting the invention as defined in the following.

DETAILED DESCRIPTION OF THE INVENTION

Figure 1:
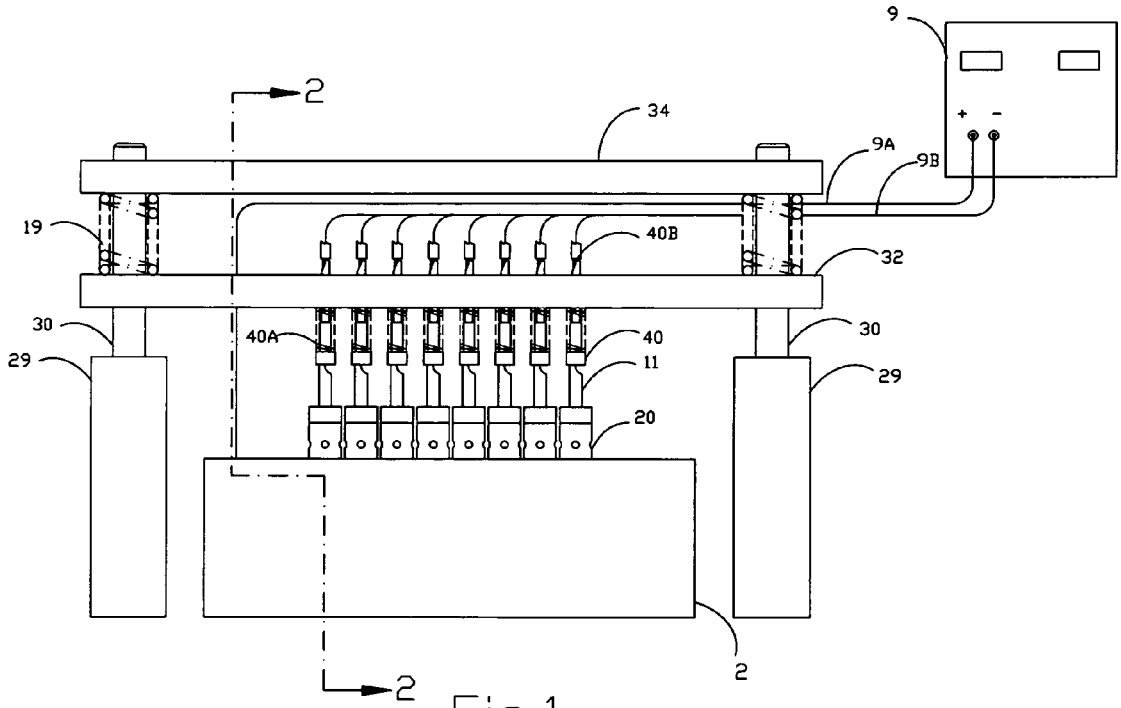
FIG. 1 is a front elevation view of a preferred embodiment of present invention showing a process tank with a receiving device having a contact engaged with conducting device.

FIG. 1 is a front elevation of the present invention. An electrolyte reservoir 2 is straddled by a plurality of support members 30. A plurality of stand offs 29 elevate the support members 30 which are attached to each other forming a frame 34 positioned above the electrolyte reservoir 2. A plurality of receiving devices 20 preferably, plating cartridges, carry contacts 11 which are positioned in an upright attitude. A plurality of contactors 40 are fixed to an insulator platen 32 so that they are in coaxial alignment with the contacts 11. A lower extremity of each contactor 40 is engaged with an upper extremity of one of the contacts 11 via reciprocating action of platen 32 by means of a plurality of compression springs 19 and the further reciprocating action of contactors 40 by means of compression springs 40A. The upper extremities of the plurality of contactors 40 are connected to a minus pole of a power supply 9 via transmission leads 9B. A transmission lead 9A is connected to a plus pole of power supply 9 and is further connected to an anode 8, as-shown, in FIG. 2.

Figure 2:
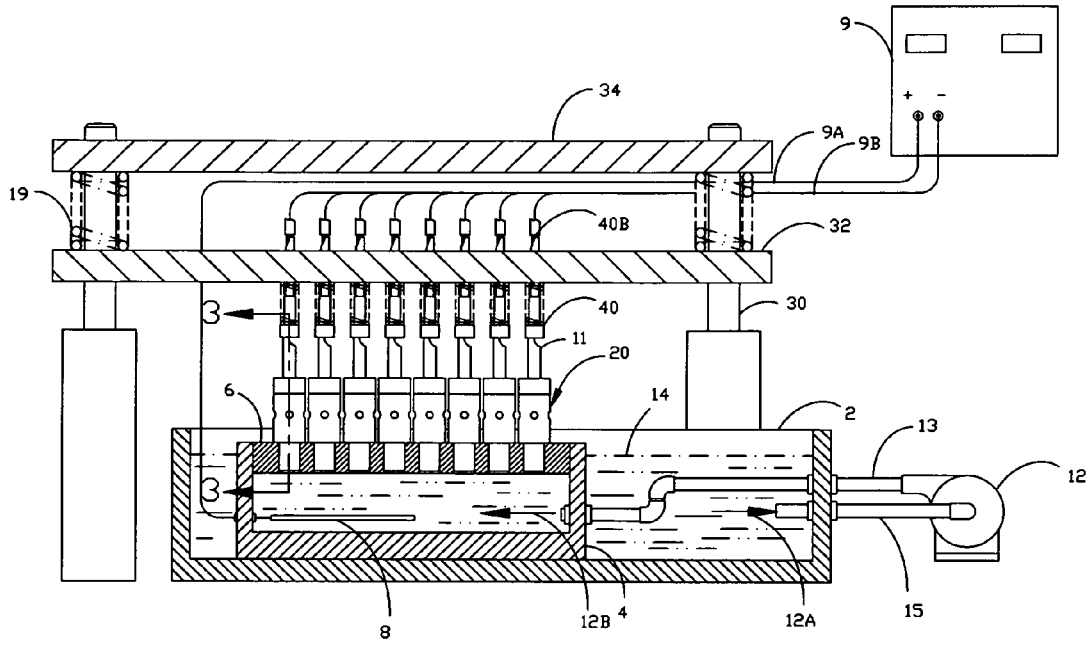
FIG. 2 is a side elevation and partial cross sectional view taken along lines 2-2 respectively in FIG. 1.

FIG. 2 is a cross section in side elevation of the present invention. The electrolyte reservoir 2 is fully purged with electrolyte 14. An electrolyte recirculation pump 12 comprises an outlet side connected to a compartment 4 by means of an outlet pipe arrangement 13. The inlet side of the pump 12 is connected by means of an intake pipe arrangement 15. The compartment 4 is placed internally within reservoir 2 and submerged in electrolyte 14. Furthermore the compartment 4 is enclosed by means of an upper manifold 6 which supports the receiving devices 20. Upon activation of pump 12 the electrolyte 14 is exhausted through the intake pipe arrangement 15 in a direction of flow indicated by arrow 12A and expelled into compartment 4 via the outlet pipe arrangement 13 as indicated by arrow 12B. The pressurization of the electrolyte 14 below the manifold 6 forces the electrolyte 14 to rise and flow through plating cartridges 20 to be expelled into electrolyte reservoir 2 as is shown in FIG. 3 and FIG. 4.

Upon activation of a plating cycle, power supply 9 delivers an electric current via lead 9A to anode 8, and further via electrolyte 14 and plating cartridges 20 to contacts 11, and still further via contactors 40 and solder connections 40B, and transmission leads 9B to the common (minus pole) of the power supply 9, thereby closing the electric circuit. It is note-worthy to mention that the volume of electrolyte dispensed and the dispersion rate determines the length of the plating cycle and the uniformity of thickness of the plating applied over a given surface area. This can be easily controlled with the aid of a control valve, not shown, positioned in line with outlet pipe arrangement 13.

Figure 3:
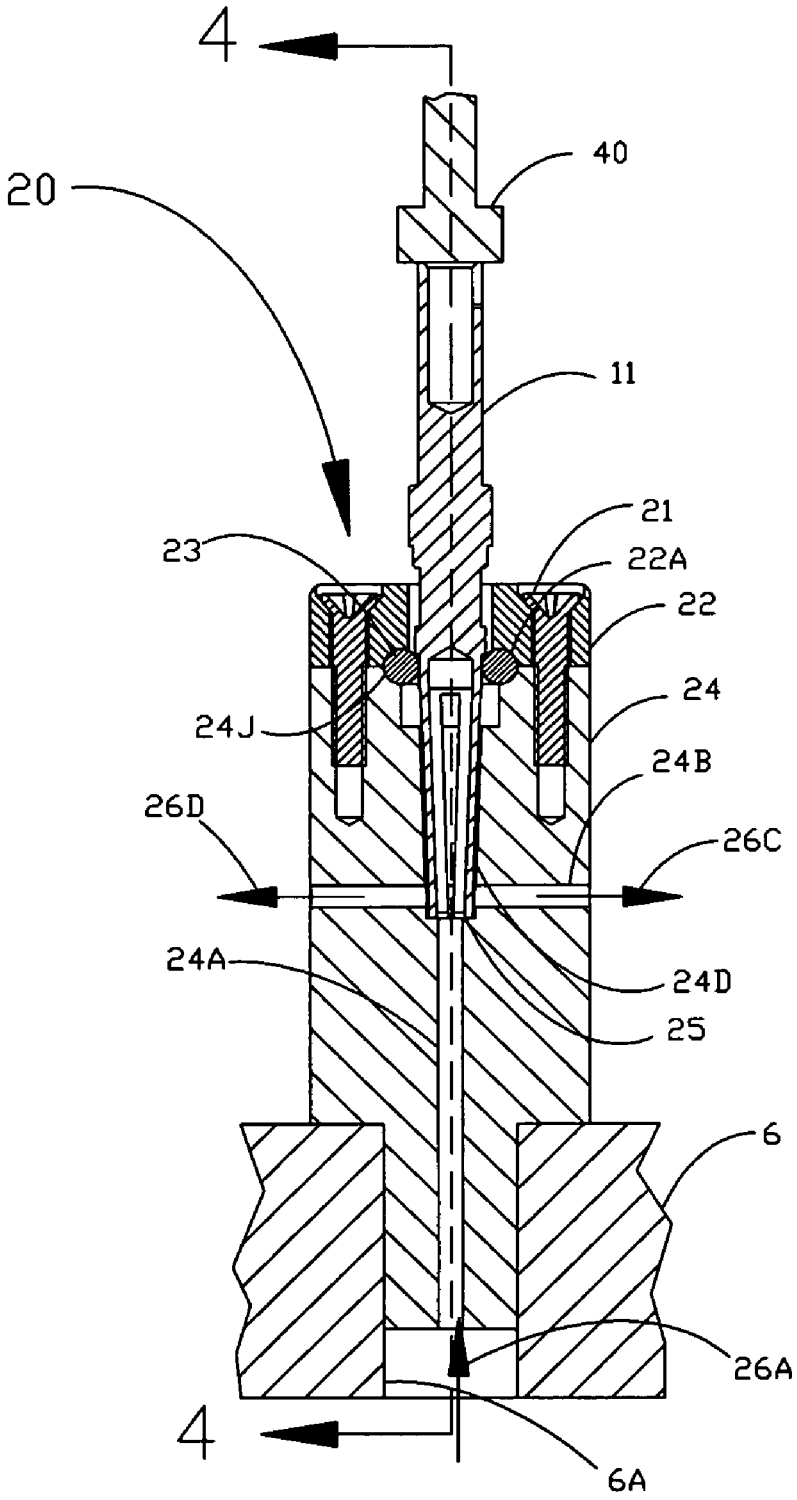
FIG. 3 is a cross sectional view with breakaway feature taken along lines 3-3 respectively in FIG. 2.
Figure 4:
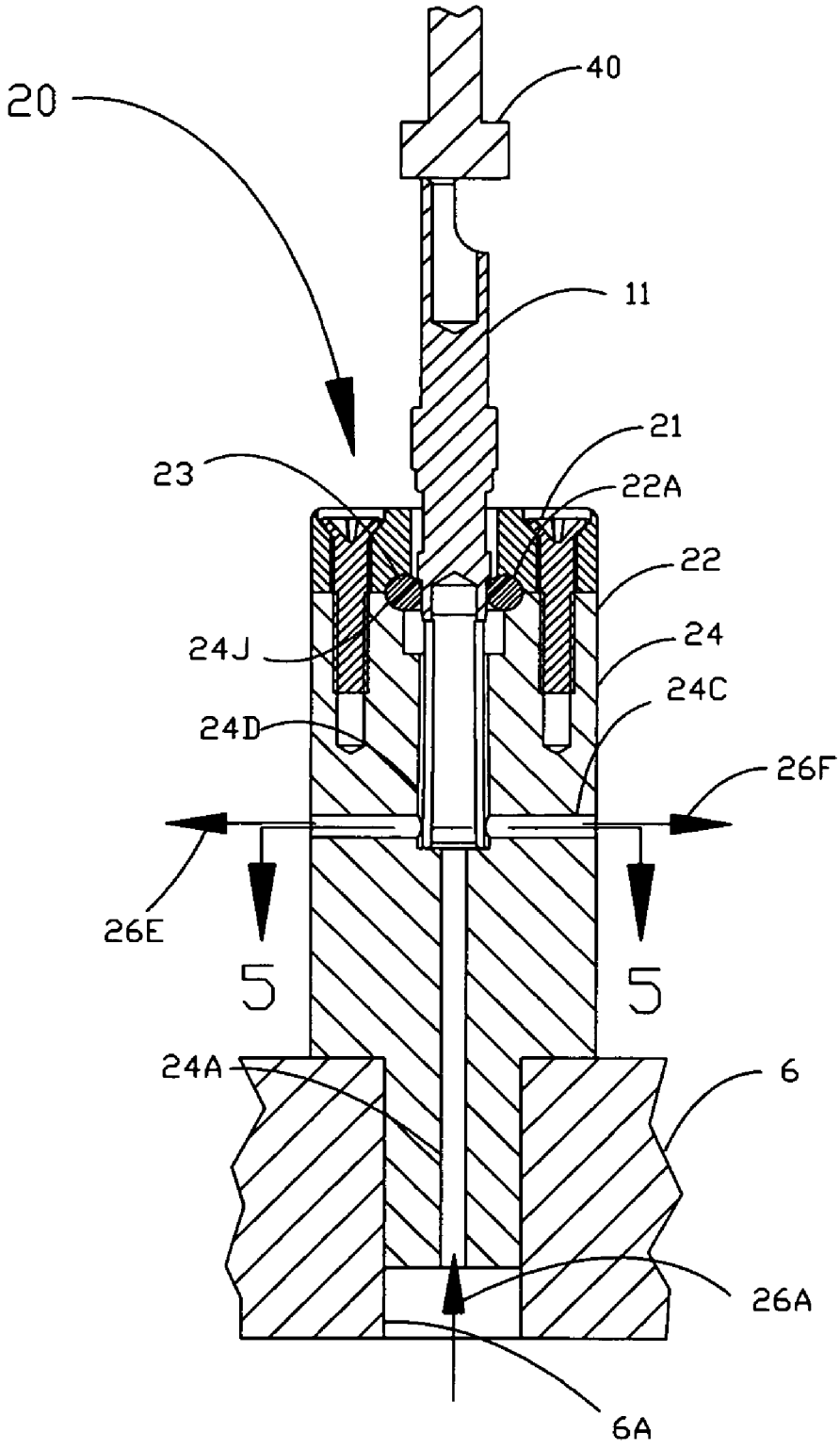
FIG. 4 is a cross sectional view taken along lines 4-4 respectively in FIG. 3.

FIG. 3 shows a partial cross section along the vertical plane of the present invention. The plating cartridge 20 comprises a cylindrical body 24 which is supported within through hole 6A of manifold 6. A sealing cap 22 is fastened by a plurality of fasteners 21 on the upper extremity of the body 24. A circular seal 23 is sandwiched between groove 24J in the upper extremity of the body 24 and the lower extremity of the sealing cap 22, with the seal 23 mated into a respective groove 22A. At the paint of engagement of the contactor 40 with the contact 11 contactor 40 urges the lower extremity of the contact 11 against land 25 of cavity 24D thereby enveloping, in close proximity, the outer contour of the lower portion of the contact 11. The inner diameter of the circular seal 23 is sized to be in immediate adjacency with the outer diameter of contact 11 thereby forming a hermetic seal. An electrolyte supply channel 24A informs a through hole configuration along the vertical plane and is axially aligned with cavity 24D. An electrolyte drain channel 24B forms a through hole configuration along the horizontal plane and is slightly elevated in vertical distance above the lower extremity of the cavity 24D and land 25, and furthermore, as shown in FIG. 4, the axis of the drain channel 24B converges with the axis of the electrolyte supply channel 24A. As shown in FIG. 2, the electrolyte 14 is pressurized by means of pump 12 and therefore flows as indicated by arrow 26A in FIG. 3, via the supply channel 24A, to flood the lower extremity of contact 11 at a height equal to or slightly higher than the upper extremity of the drain channel 24B. Specifically contact 11 at the point of adjacency with the circular seal 23 is provided with an airtight seal thereby preventing air from being evacuated from cavity 24D below the circular seal 23. This "airlock" prevents electrolyte 14 from rising higher than slightly above the drain channel 24B prior to being discharged in direction of flow as indicated by arrows 26C and 26D.

It is noteworthy to mention that a plating process is most efficient and uniform for as long as an adequate volume of electrolyte is constantly exposed to the surface to be plated. The critical area for best function of a female contact is that the lower portion of the inside mating area is plated in sufficient thickness with gold. With the described arrangement, a large volume of electrolyte is exposed to the inside diameter of contact 11 whereas the outside diameter thereof is sufficiently masked by the sleeve configuration of cavity 24D providing a greatly minimized volume of electrolyte exchange on its surface. As such the thickness of gold is of a considerably lesser thickness on the outside diameter of contact 11, also known as the "non-functional area," and greatly increased in thickness on the inside diameter respectively thereof, also known as the "functional area." A further critical requirement is that the vertical distance of the plating measured from the tip of contact 11 should be only slightly greater than a product specification might require. Therefore it is very conceivable that the vertical distance of drain channel 24B, as measured from the land 25, determines the height of the plating because as soon as the level of electrolyte 14, supplied via supply channel 24A, exceeds the total area of the opening of the drain channel 24B, entrapped air prevents the level of electrolyte 14 from rising any further forcing it to evacuate via the drain channel 24B. It is well known in industry that the prior art teaches the submerging of the contact to a given depth into an open reservoir of electrolyte wherein the depth is the vertical distance as measured from the bottom tip of the contact to the surface of the electrolyte at a ratio of 2.5 to 1 for the plating to take effect. This means that to achieve a specified plating thickness at the depth of 1, the contact has to be submerged into the electrolyte at 2.5 times the depth of 1. As a consequence, to achieve this it further means that a sufficient plating thickness at 1 necessitates an area of 1.5 in addition to 1 to be plated at a thickness equal to the thickness at 1. A primary reason for this is that the volumetric exchange of electrolyte is insufficient to produce a specified thickness of the plating at a given depth for any length of plating time unless the contact is sufficiently submerged in depth into the electrolyte. Negating the effect of an airlock as described above in addition to negating a targeted and dynamic volumetric electrolyte exchange enabled by the plating cartridge configuration furthermore negates the ability to limit the plating to areas where it is needed to satisfy a specified plating thickness at a specified area of contact 11.

In preference for achieving optimized plating efficiency and a minimum of gold consumption respectively, a gap separates beams of the female contact 11 and are aligned with drain channels 24C and 24B as shown in FIG. 3 and FIG. 4 the latter showing a cross section view along line 4-4 of FIG. 3. Therefore, we have provided a means for sufficient drainage of the electrolyte 14 via drain channel 24C in the direction of flow as indicated by arrows 26F and 26E respectively for maintaining an optimized volumetric exchange of the electrolyte 14 during the plating cycle. The automatic orientation of contact 11 is easily achieved by means of sensor equipment readily available in commerce.

Figure 5:
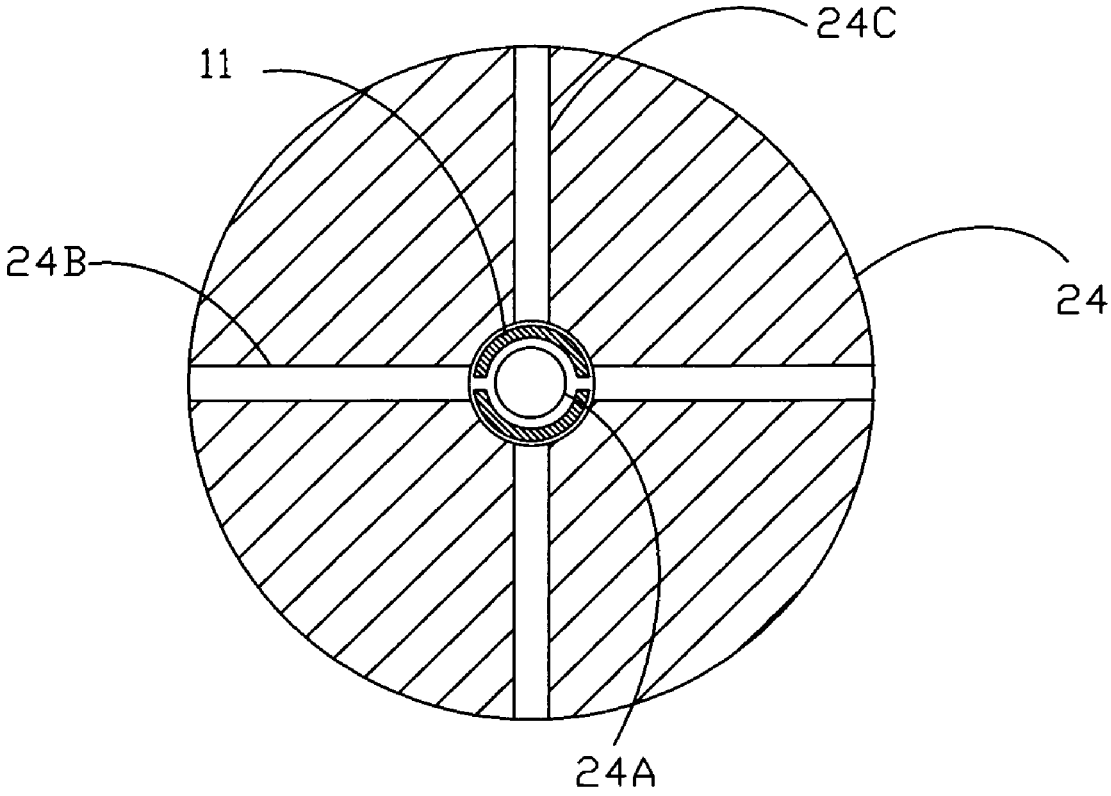
FIG. 5 is a cross sectional view taken along lines 5-5 respectively in FIG. 4.

FIG. 5 is a cross section along lines 5-5 on FIG. 4 showing drain channels 24B and 24C respectively axially intersecting each other and supply channel 24A. It is contemplated that a shut-off mechanism like a plug type feature may be used for disabling drain channel 24B and 24C respectively and can be provided as an optional feature advantageous for process performance under certain conditions such as when a required flow rate of electrolyte 14, is needed in combination with the configuration of the contact 11. Furthermore, as shown in FIG. 4, the gaps separating the opposing tines of contact 11 are axially aligned with the drain channel 24B.

Figure 6:
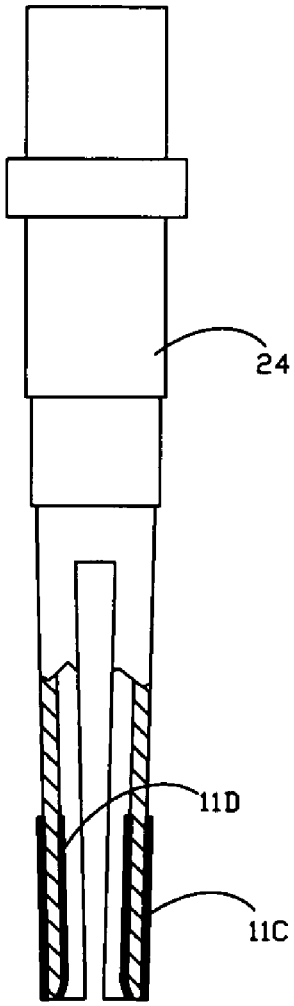
Fig.6 (prior art)
FIG. 6 is a front elevation of a female contact having a cut away cross section view of the mating end.

FIG. 6 shows a cut away cross section view of the mating end of contact 11 after being gold plated as is practiced with prior art. The plating is shown in heavy lines 11C and 11D respectively whereby the line thickness denominates the thickness of the plating. The plating 11D is necessary for proper functioning of contact 11 when it is installed into a connecting device.

Figure 7:
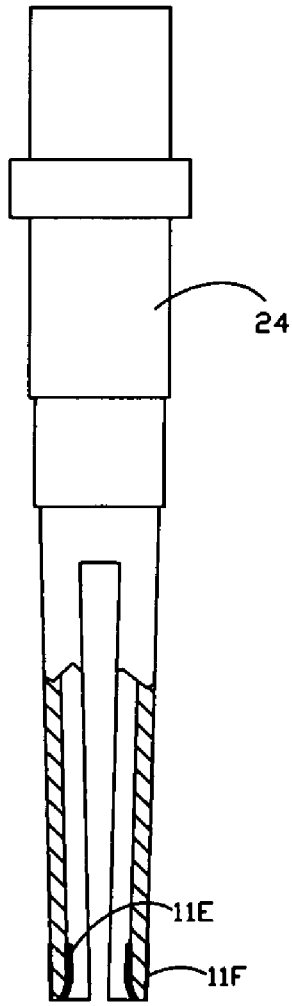
FIG. 7 is a further front elevation of a female contact having a cut away cross section view of the mating end.

FIG. 7 shows a cut away cross section view of the mating end of contact 11 after the gold plating thereof performed with the present invention. The plating 11E represents the functional area whereby the plating 11F is the nonfunctional area respectively. The plating 11F is shown in a lesser line thickness in comparison to 11E for demonstrating the degree of plating thickness. The thickness of lines 11D and 11C (FIG. 6) versus the plating thickness of lines 11E and 11F (FIG. 7) are of differing thickness. Furthermore as is easily recognizable the plating depth as depicted by the length of lines 11D and 11C versus the length of lines 11E and 11F are of greatly unequal length. In retrospect prior art selective gold plating for contacts has a significant disadvantage in comparison to the present invention thereby rendering the present invention as a superior plating method in terms of minimizing gold consumption for selective plating of female contacts.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specifications as including more than one meaning, then its use must be understood as being generic to all possible meanings supported by the specifications and by the word or words describing the element. The definitions of the words or elements of the embodiments of the herein described invention and its related embodiments not described are, therefore, in this specifications to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim. Changes from the claimed subject matter as viewed by a person with ordinary skill in the art, not known or later devised, are expressly contemplated as being equivalents within the scope of the invention and its various embodiments. Therefore, obvious substitutions now or later known to one with ordinary skill in the art defined to be within the scope of the defined elements. The invention and its various embodiments are thus to be understood to include what is specifically illustrated and described above, what is conceptually equivalent, what can obviously substituted, and also what essentially incorporates the essential idea of the invention. While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. An electroplating apparatus comprising:

an electrolyte reservoir having an electrolyte solution therein;

a compartment positioned within the reservoir and filled with the electrolyte solution;

an upper manifold covering and sealing the compartment;

a plurality of plating cartridges extending upwardly from the upper manifold, each of the plating cartridges terminating with a contact;

an insulator platen positioned above the compartment and spaced apart therefrom;

a plurality of contactors fixed to the insulator platen, a lower extremity of each one of the contactors positioned in contact with an upper extremity of one of the contacts;

an electrolyte recirculation pump engaged with the compartment and enabled for pressurizing the electrolyte solution within the compartment thus forcing the electrolyte solution to rise and flow through the plating cartridges;

an anode positioned within the electrolyte solution within the compartment; and a power supply electrically interconnected with the anode and with each of the contactors for providing an electroplating current.

2. The electroplating apparatus of claim 1 wherein each said plating cartridge comprises a cylindrical body supported within a through hole in a manifold.

3. The electroplating apparatus of claim 2 wherein a sealing cap is fastened on each cylindrical body by a fastener.

4. The electroplating apparatus of claim 3 wherein a compliant seal is mated within a groove in each cylindrical body and secured therein by the sealing cap.

5. The electroplating apparatus of claim 4 wherein at a point of engagement between each contactor and contact pair, the contactor is enabled for pressing downwardly on the contact urging engagement between the contact and a recess land of a cavity of one said plating cartridge, thereby enveloping, in close proximity, an outer contour of a lower portion of the contact.

6. The electroplating apparatus of claim 5 wherein an inner diameter of each compliant seal forms a tight contact with an outer diameter of each contact.

7. The electroplating apparatus of claim 6 wherein in each of the cylindrical bodies, an electrolyte supply channel is formed as a first hole along a vertical plane and is axially aligned with the cavity.

8. The electroplating apparatus of claim 7 wherein in each of the cylindrical bodies, an electrolyte drain channel forms a second hole along a horizontal plane and is slightly elevated above the recess land, the drain channel intersecting the electrolyte supply channel.

9. The electroplating apparatus of claim 8 wherein gaps between beams of the contact are aligned with the drain channels, thereby providing drainage of the electrolyte solution so as to maintain an optimized volumetric exchange of the electrolyte during a plating cycle.

10. The electroplating apparatus of claim 8 wherein gaps separating opposing tines of the contact are aligned with the drain channel.

* * * * *